US007566027B1

(12) United States Patent
Johnson et al.

(10) Patent No.: US 7,566,027 B1
(45) Date of Patent: Jul. 28, 2009

(54) ROLL ORIENTATION USING TURNS-COUNTING FUZE

(75) Inventors: Lyle H. Johnson, Bloomington, MN (US); Dennis L. Kurschner, Minnetonka, MN (US)

(73) Assignee: Alliant Techsystems Inc., Minneapolis, MN (US)

( * ) Notice: Subject to any disclaimer, the term of this patent is extended or adjusted under 35 U.S.C. 154(b) by 450 days.

(21) Appl. No.: 11/342,736

(22) Filed: Jan. 30, 2006

(51) Int. Cl.
*F41G 9/00* (2006.01)
*F42B 10/00* (2006.01)

(52) U.S. Cl. ..... 244/3.21; 244/3.23; 244/3.1; 102/473; 702/151

(58) Field of Classification Search ..... 244/3.21, 244/3.23, 3.1, 3.15; 102/473, 293, 499, 501; 342/62; 324/207.15; 702/151
See application file for complete search history.

(56) References Cited

U.S. PATENT DOCUMENTS

| | | | | |
|---|---|---|---|---|
| 4,328,938 | A | 5/1982 | Reisman et al. | 244/3.1 |
| 4,767,988 | A * | 8/1988 | Wilson | 324/247 |
| 4,967,981 | A | 11/1990 | Yff | 244/3.21 |
| 4,979,696 | A | 12/1990 | Yff | 244/3.14 |
| 5,497,704 | A | 3/1996 | Kurschner et al. | 102/264 |
| 5,740,986 | A * | 4/1998 | Seidensticker et al. | 244/3.15 |
| 6,094,054 | A | 7/2000 | Crist | 324/452 |
| 6,163,021 | A * | 12/2000 | Mickelson | 244/3.2 |
| 6,208,936 | B1 * | 3/2001 | Minor et al. | 701/220 |
| 6,349,652 | B1 | 2/2002 | Hepner et al. | 102/519 |
| 6,378,801 | B1 | 4/2002 | Pell et al. | 244/3.24 |
| 6,398,155 | B1 | 6/2002 | Hepner et al. | 244/3.15 |
| 6,493,651 | B2 | 12/2002 | Harkins et al. | 702/151 |
| 6,502,786 | B2 | 1/2003 | Rupert et al. | 244/3.27 |
| 6,889,934 | B1 * | 5/2005 | Thomas et al. | 244/3.19 |
| 7,341,221 | B1 * | 3/2008 | Wilson | 244/3.21 |
| 2006/0289694 | A1 * | 12/2006 | Bredy | 244/3.1 |

* cited by examiner

*Primary Examiner*—James S Bergin
(74) *Attorney, Agent, or Firm*—Vidas, Arrett & Steinkraus, P.A.

(57) ABSTRACT

The present invention comprises a device for determining the roll orientation of a body with respect to a local fixed coordinate system or a predetermined reference vector. The device uses a measurement of an external magnetic field, such as the Earth's magnetic field, to determine a roll orientation reference with respect to the field or an uncompensated roll orientation. The uncompensated roll orientation is then adjusted according to a bias angle, such as an angular difference between the external magnetic field and a local fixed coordinate system, to determine the roll orientation of the device with respect to the local fixed coordinate system or a compensated roll angle.

22 Claims, 5 Drawing Sheets

ROLL ORIENTATION USING TURNS-COUNTING FUZE

BACKGROUND OF THE INVENTION

This invention relates to the field of projectiles and more particularly to an apparatus and method for determining the roll attitude of a projectile with respect to a fixed local coordinate system.

Modern weapons often require knowledge of their attitude in space for control purposes. The actual roll orientation of a body with respect to a local coordinate system may be used for a number of purposes. For example, roll orientation of a directional air bursting munition is desirable to achieve proper fragmentation placement upon detonation. Thus, detonation of a directional air bursting munition desirably occurs at a particular roll orientation with respect to the environment. Additionally, the actual roll orientation of a projectile may be considered in the activation of divert mechanisms used to steer a weapon toward a desired target.

Systems for determining the attitude of a weapon have included side mounted sensors, such as radar, for determining the relative presence or absence of ground beneath the sensor, gyroscopic and angle-rate sensors to determine the body pitch-over that occurs as a weapon falls due to gravity, inertial sensors calibrated prior to launch that remember the original attitude reference, and the like.

The aforementioned methods of sensing projectile attitude in modern weapons systems include various drawbacks. Inertial sensors are generally not useful in spin stabilized projectiles. Expensive and delicate sensors add to the cost of each weapon and can suffer damage associated with high launch forces and high in-flight temperatures. The marginal cost of such added components can often outweigh the associated marginal benefit.

It would be desirable to provide a system for determining roll orientation of a weapon using low cost sensors and electronics. Desirably, the system may utilize components that are already included in the projectile fuzing system. Further, it would be desirable for such a system to have no moving parts.

SUMMARY OF THE INVENTION

The present invention comprises a device for determining the roll orientation of a body with respect to a local fixed coordinate system. The device uses a measurement of an external magnetic field, such as the Earth's magnetic field, to determine a roll orientation reference with respect to the field or an uncompensated roll orientation. The roll orientation reference is then adjusted according to a bias angle, such as an angular difference between the external magnetic field and a local fixed coordinate system, to determine the roll orientation of the device with respect to the local fixed coordinate system or a compensated roll angle.

In one embodiment, the present invention comprises a system for determining the roll orientation of a projectile with respect to a local coordinate system. A projectile may include a magnetic transducer which generates an output signal corresponding to an uncompensated roll angle of the projectile, or a roll angle with respect to an external magnetic field, such as a portion of the Earth's magnetic field. A roll angle determination circuit may combines the output signal generated by the magnetic transducer with a bias angle constant to determine a compensated roll angle of the projectile. The bias angle may comprise a measurement between the Earth's magnetic field and a reference vector of the local coordinate system. The compensated roll angle, or roll angle of the magnetic transducer with respect to the reference vector is then known.

In another embodiment, the present invention may comprise a fuze for use with a projectile. The fuze may include a magnetic transducer which generates an output signal corresponding to an uncompensated roll angle of the projectile and a roll angle determination circuit which combines the output signal generated by the magnetic transducer with a bias angle constant to determine a compensated roll angle of the projectile.

The invention is also directed to a method of determining the roll attitude of a projectile with respect to a local reference vector. A projectile may be provided having a magnetic transducer which generates an output signal corresponding to an uncompensated roll angle of the projectile according to an external magnetic field. A bias angle between a predetermined local reference vector and the two-dimensional vector component of the external magnetic field disposed in the sensitive plane of the magnetic transducer may be measured. The output signal of the magnetic transducer may be adjusted according to the bias angle to determine the roll orientation of the projectile with respect to the local reference vector.

DETAILED DESCRIPTION

While this invention may be embodied in many different forms, there are described in detail herein specific embodiments of the invention. This description is an exemplification of the principles of the invention and is not intended to limit the invention to the particular embodiments illustrated.

Projectiles and electronic fuzes are known in the art. The present invention comprises a device and method for determining the roll orientation of a projectile with respect to a local coordinate system.

Figure 1:
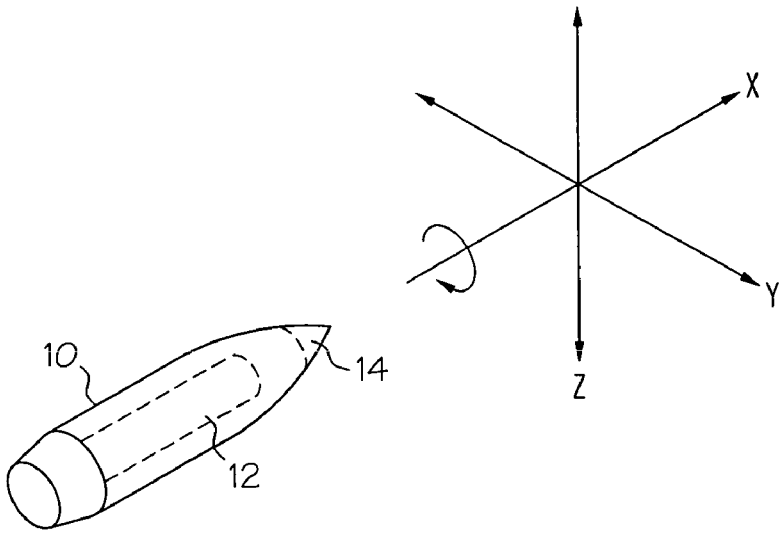
FIG. 1 shows a projectile and a reference coordinate system.

Referring to FIG. 1, a projectile 10 is depicted along with a 3-dimensional reference axis illustration. Generally, a projectile 10 may travel along an x-axis. A spin stabilized projectile may also spin about the x-axis. A yz-plane is generally transverse to the x-axis.

It is generally desirable to know the roll orientation of a projectile 10 with respect to an environmental coordinate system. The roll orientation may be useful for a number of reasons, such as for activation of divert mechanisms to change the trajectory of the projectile. Further, a projectile 10 may comprise an air bursting munition. Air bursting munitions may include a directional burst zone 12 wherein a majority of the explosive forces and fragmentation are directed. A directional burst zone 12 may extend orthogonal to the x-axis over a predetermined arc range in the yz-plane. It is desirable for projectile detonation to occur when an intended target is within the directional burst zone 12.

A projectile 10 may include a fuze 14, such as a remote settable fuze. A remote settable fuze 14 allows external information to be received by the projectile 10 before launch. One known method for inputting information to the fuze 14 is by non-contact inductive coupling, as discussed in U.S. Pat. No. 5,497,704, the entire disclosure of which is incorporated herein by reference.

Generally, fuze setting by inductive coupling comprises a magnetic waveform transmitted from a fuze setter to a fuze. Magnetic flux passes between the fuze and the fuze setter to transfer operational power and fuze setting information to the fuze. The waveform generally comprises a frequency modulated carrier signal. The information input to the fuze 14 relates to a fuze mode setting or for example, may contain a time-to-burst or turns-to-burst instruction for the projectile 10. Time-to-burst represents a predetermined time period after firing, approximating a desired range, after which the projectile detonates. Turns-to-burst represents a predetermined number of turns that the projectile 10 will experience before detonation. The number of turns generally corresponds to a predetermined travel distance for the projectile. The present invention advances the capabilities of the projectile 10 by allowing detonation at a desired roll orientation.

Figure 2:
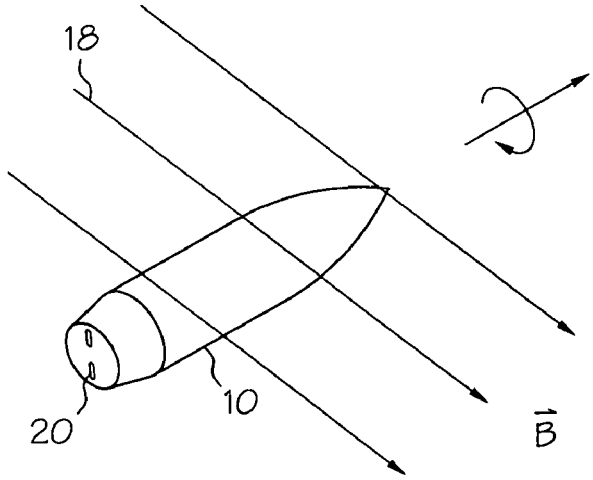
FIG. 2 depicts a projectile passing through a magnetic field.

FIG. 2 depicts another view of a projectile 10. As a projectile 10 travels, it generally passes through a magnetic field, such as the Earth's magnetic field 18 or other more localized magnetic fields. Desirably, a magnetic field 18 is substantially homogeneous along the travel path of the projectile. In one embodiment, a projectile 10 may include a magnetic transducer 20 that creates an electrical output based upon it's orientation within a magnetic field 18. Desirably, the magnetic transducer 20 comprises a search-coil. In some embodiments, a magnetic transducer 20 may comprise a three-axis magnetometer.

The magnetic transducer 20 is sensitive to the vector components of the magnetic field 18 that lie in the sensitive axis of the magnetic transducer 20. Desirably, the sensitive axis of the magnetic transducer 20 lies in the transverse or yz-plane of the projectile 10. Thus, the magnetic transducer 20 may be sensitive to the components of a magnetic field 18 that lie in the yz-plane of the projectile 10, or the two-dimensional magnetic field vector $\mathbf{18}_{yz}$ as shown in FIG. 3.

Figure 3:
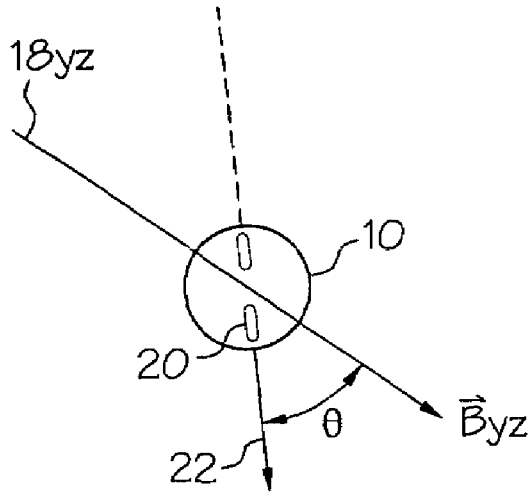
FIG. 3 shows a rear view of a projectile.
Figure 4:
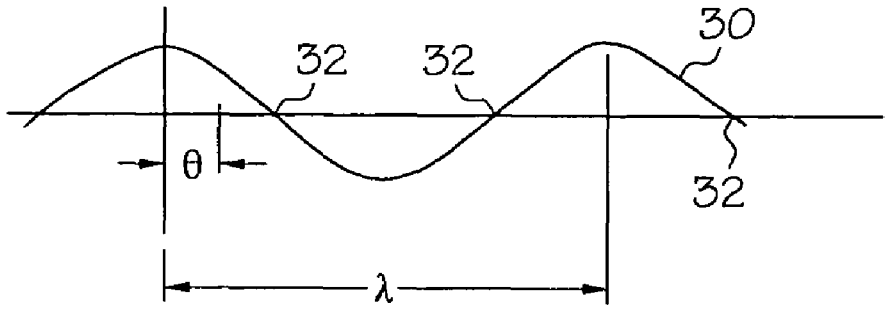
FIG. 4 depicts an example of a sinusoidal output signal produced by a magnetic transducer rotating in a magnetic field.

Referring to FIGS. 3 and 4, as the magnetic transducer 20 rotates in relation to a magnetic field 18, or more specifically, in relation to the two-dimensional magnetic field vector $\mathbf{18}_{yz}$, it generates a sinusoidal output signal 30. One complete sine wave cycle or wavelength $\lambda$ is generated for each 360° revolution of the magnetic transducer 20. The relative magnitude and phase of the output signal 30 is directly related to the uncompensated roll angle $\theta$ between the two-dimensional magnetic field vector $\mathbf{18}_{yz}$ and a magnetic transducer vector 22 representing the sensitive axis of the magnetic transducer 20.

The sinusoidal output signal 30 will generally have a peak positive voltage when the magnetic transducer vector 22 is parallel to the two-dimensional magnetic field vector $\mathbf{18}_{yz}$. The voltage amplitude generally drops as the magnetic transducer 20 rotates, until the voltage reaches zero at a quarter turn of the projectile. The voltage will then reverse direction and reach a negative peak at the half turn point. The amplitude again decreases until reaching zero at the three quarters turn point, and then again reverses and again reaches a positive maximum when one complete turn has been made.

The sinusoidal output signal 30 from the magnetic transducer 20 continues for the total life of the flight of the projectile 10. The output signal 30 may be analyzed by a phase angle detector to determine an uncompensated roll angle $\theta$ between the magnetic transducer vector 22 and the two-dimensional magnetic field vector $\mathbf{18}_{yz}$.

Figure 5:
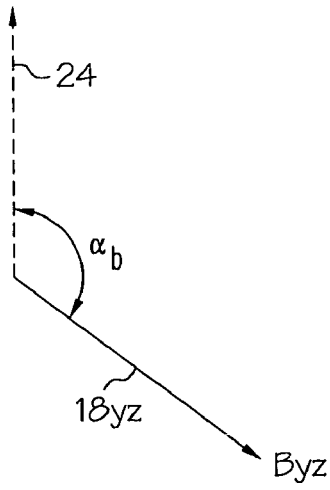
FIG. 5 shows an example of a bias angle between a reference vector and a two-dimensional magnetic field vector.

In order to relate the uncompensated roll angle $\theta$ to a local fixed coordinate system, the uncompensated roll angle $\theta$ must be adjusted according to an adjustment factor comprising the angle between the magnetic field 18 and a local coordinate system. Referring to FIG. 5, a reference vector 24 may be used to provide a baseline for determining an adjustment factor or bias angle $\alpha_b$ between the reference vector 24 and the two-dimensional magnetic field vector $\mathbf{18}_{yz}$. The reference vector 24 desirably lies in the transverse plane of the magnetic transducer 20 and may point in any direction. As shown in FIG. 5, the reference vector 24 may represent a local vertical.

Desirably, the bias angle $\alpha_b$ may be measured before or during fuze programming and transmitted to the fuze by the fuze setter along with the other fuze setting information prior to launch. The bias angle $\alpha_b$ may be stored in the fuze memory and used to adjust the uncompensated roll angle $\theta$ to determine the compensated roll angle $\phi$ or roll angle of the projectile 10 with respect to the reference vector 24.

Figure 6:
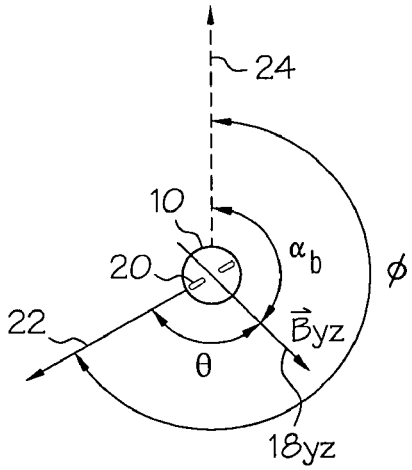
FIG. 6 shows a rear view of a projectile and a number of angular measurements pertinent to the invention.

FIG. 6 shows an example of a projectile 10 and magnetic transducer 20, a two-dimensional magnetic field vector $\mathbf{18}_{yz}$ and a reference vector 24. As the projectile 10 spins, the uncompensated roll angle $\theta$ between the magnetic transducer vector 22 and the two-dimensional magnetic field vector $\mathbf{18}_{yz}$ is determined as a function of the output of the magnetic transducer 20. The reference vector 24 represents a local vertical. The bias angle $\alpha_b$ between the reference vector 24 and the two-dimensional magnetic field vector $\mathbf{18}_{yz}$ may be added to the uncompensated roll angle $\theta$ to determine the compensated roll angle $\phi$ or orientation of the magnetic transducer vector 22 with respect to the reference vector 24.

Although the Earth's magnetic field changes direction over substantial distances, it is generally assumed to be constant along the relatively short trajectories of most projectiles. Generally, a magnetic field 18 will comprise a three-dimensional magnetic field. Therefore, the exact angular direction of the two-dimensional magnetic field vector $\mathbf{18}_{yz}$ changes as the trajectory or aim of the projectile 10 changes.

In a preferred embodiment, the trajectory of the projectile 10 and a reference vector 24 may be chosen, and the actual bias angle $\alpha_b$ between the reference vector 24 and the two-dimensional magnetic field vector $\mathbf{18}_{yz}$ in the transverse plane of the projectile 10 may be directly measured by the launching platform. The bias angle $\alpha_b$ may be transmitted from a fuze setter to the fuze 14 along with the other fuze setting data.

In other embodiments, a predicted bias angle $\alpha_b$ may be used. The predicted bias angle $\alpha_b$ may be based upon known models of the Earth's magnetic field. Generally, when various parameters such as the three-dimensional location on or above the Earth, time, and the intended trajectory of the projectile 10 including heading and elevation are known, the two-dimensional magnetic field vector $\mathbf{18}_{yz}$ may be predicted, and thus, the bias angle $\alpha_b$ may be predicted. The parameters needed to predict a bias angle $\alpha_b$ are commonly known to the fire control system of a launch platform.

The compensated roll angle $\phi$ may be used by the onboard systems of the fuze 14 in completing the mission. For example, a directional bursting munition may be instructed to detonate when the burst zone 12 is facing downward, or when the burst zone is rotated 180° away from a local vertical reference vector 24. Desirably, a directional bursting munition may be constructed having the burst zone 12 centered with the transducer vector 22.

Figure 7:
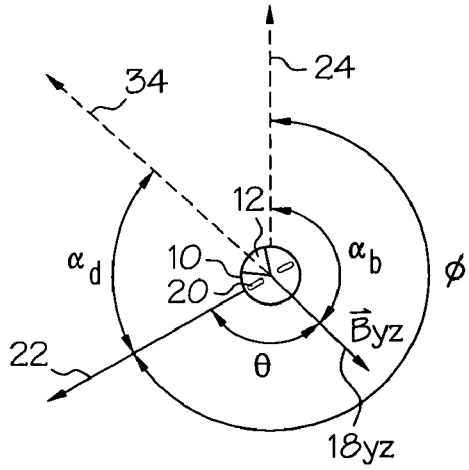
FIG. 7 shows a rear view of a projectile having a directional burst zone and a number of angular measurements pertinent to the invention.

Referring to FIG. 7, when a projectile 10 is constructed such that a burst zone 12 is not centered upon the transducer vector 22, it is desirable to calculate the roll angle of the burst zone 12 with respect to the reference vector 24. A burst zone vector 34 centered in the burst zone 12 may extend from the projectile 10. A directional burst zone adjustment angle $\alpha_d$ may comprise the angle between the burst zone vector 34 and the transducer vector 22. By adjusting the compensated roll angle $\phi$ according to the directional burst zone adjustment angle $\alpha_d$, the angle of the burst zone vector 34 with respect to the reference vector 24 may be calculated. Thus, the fuze 14 may be instructed to detonate the projectile 10 when the burst zone 12 is at a predetermined roll angle with respect to a selected reference vector 24.

A directional burst zone adjustment angle $\alpha_d$ is a constant for an assembled fuze 14 because it is a measurement of an angle between parts internal to the fuze 14, and independent from any magnetic fields 18. Desirably, the directional burst zone adjustment angle $\alpha_d$ may be measured and preprogrammed into the fuze 14 during fuze construction. However, if a fuze 14 is not preprogrammed with a directional burst zone adjustment angle $\alpha_d$, the directional burst zone adjustment angle $\alpha_d$ may be transmitted to the fuze 14 by a fuze setter during the fuze setting operation.

Figure 8:
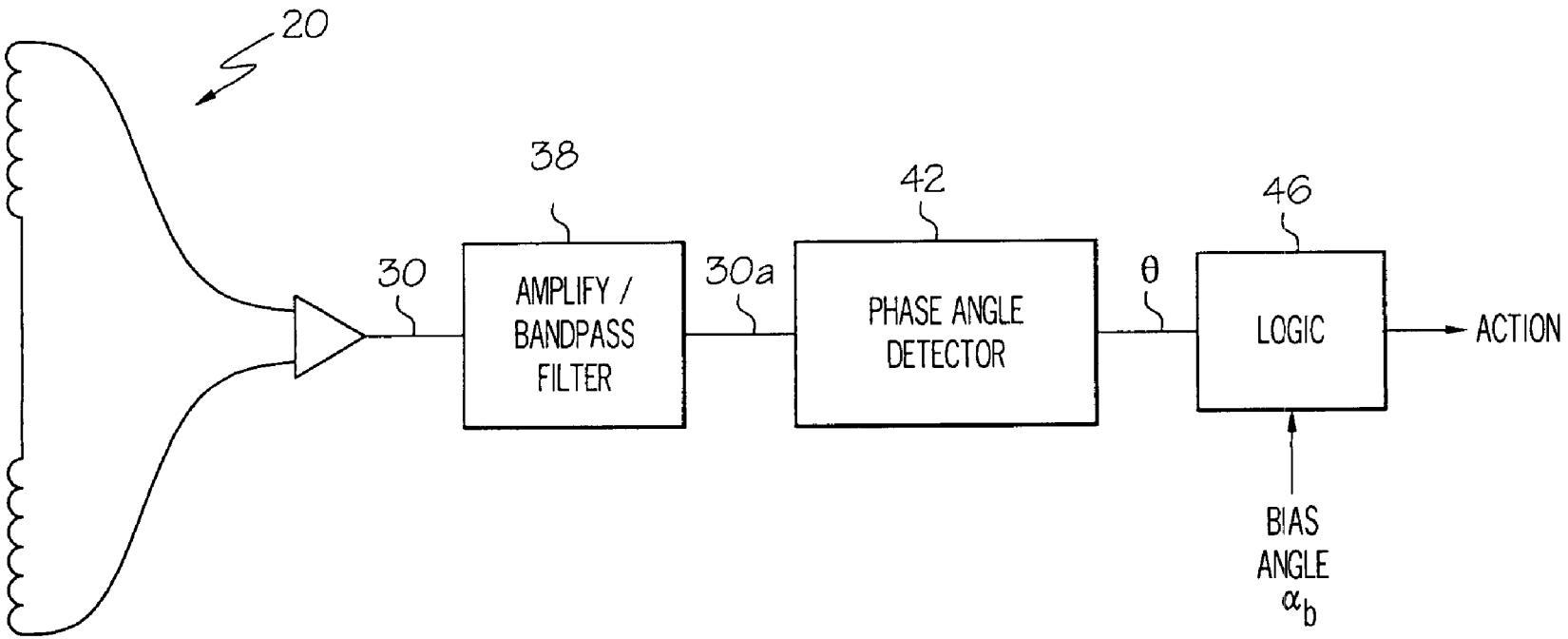
FIG. 8 shows an embodiment of the invention.

FIG. 8 shows a schematic drawing of an embodiment of the invention. A magnetic transducer 20 generates a sinusoidal output signal 30. The output signal 30 may be filtered and amplified, as shown in block 38. The filtered output signal 30*a* may be provided to a phase angle detector 42, wherein the uncompensated roll angle $\theta$ may be calculated. A logic circuit 46, which may be provided with the bias angle $\alpha_b$ as described above, may adjust the uncompensated roll angle $\theta$ according to the bias angle $\alpha_b$ to arrive at the compensated roll angle $\phi$. The logic circuit 46 may cause an action upon the satisfaction of fuze detonation conditions. An action may comprise any fuze function, such as detonation, sterilization or the activation of divert mechanisms.

Figure 9:
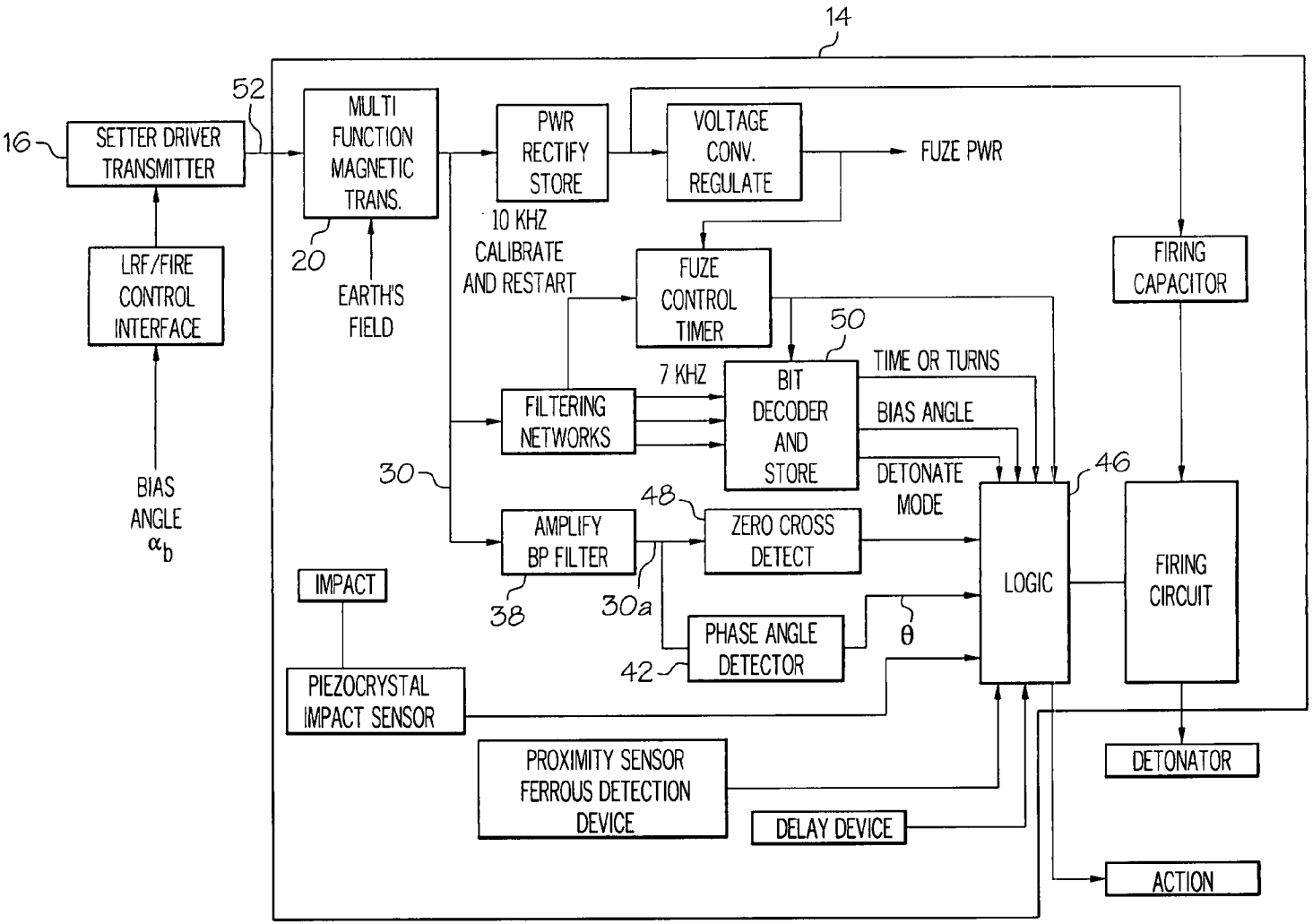
FIG. 9 shows another embodiment of the invention.

FIG. 9 shows a schematic drawing of another embodiment of the invention. A fuze 14 may be provided, and fuze setting information may be transmitted to the fuze 14 by a setter 16 as described in U.S. Pat. No. 5,497,704. An inductive modulated carrier signal 52 containing fuze setting data may be received by a magnetic transducer 20. The fuze setting data may include a bias angle $\alpha_b$. The fuze setting data may be decoded as shown in block 50 and provided to a fuze logic circuit 46. The projectile may then be launched.

During projectile flight, the magnetic transducer 20 may generate a sinusoidal output signal 30. The output signal 30 may be filtered and amplified, as shown in block 38. The filtered output signal 30*a* may be provided to a phase angle detector 42, wherein the uncompensated roll angle $\theta$ may be calculated. The filtered output signal 30*a* may also be provided to a zero crossing detector 48 which may be used to count the number of turns of the projectile. The uncompensated roll angle $\theta$ and number of turns data may be provided to the fuze logic circuit 46, wherein projectile flight distance and the compensated roll angle $\phi$ may be calculated. The logic circuit 46 may cause an action, such as detonation or other action, upon the satisfaction of fuze detonation conditions, such as the projectile reaching an appropriate distance and compensated roll angle $\phi$.

In one embodiment, an inventive projectile 10 may be fired from a handheld firing platform such as an XM29 Objective Individual Combat Weapon. Desirably, the firing platform may include a range finder and a detonation instruction interface. The operator may use the range finder to determine the range to the intended target. Fuze setting information may be provided to the firing platform via the detonation instruction interface and include data such as distance-to-burst and angle-of-burst chosen by the operator. The firing platform may then program the fuze, and the projectile 10 may be fired.

For the purposes of determining the roll orientation of a projectile 10 along a substantially straight flight path, the direction and magnitude of Earth's magnetic field 18 is generally assumed to be constant from the firing point of the projectile to the burst point. However, changes in the Earth's magnetic field 18 may be accounted for when longer trajectories and ballistic curvature are involved, such as when firing artillery shells. Further, the orientation of the transverse axis of a projectile changes as the projectile traverses a ballistic path.

In cases where ballistic curvature will impact the projectile flight path, mathematic equations predicting the nominal trajectory of the projectile may be transmitted to the fuze by the fuze setter before launch. Such equations may include functions to account for changes in the external magnetic field based upon known models, and to account for the changing attitude of the transverse plane of the projectile. The fuze may then calculate the projected two-dimensional magnetic field vector in the transverse plane of the projectile to refine the bias angle throughout the flight.

In some embodiments, the invention is directed to a method, for example as described in the following paragraphs:

1. A method of determining the roll attitude of a projectile comprising:
   a) providing a projectile having a magnetic transducer which generates an output signal corresponding to an uncompensated roll angle of the projectile according to an external magnetic field;
   b) determining a bias angle between a predetermined local vector and the two-dimensional vector component of the external magnetic field disposed in the sensitive plane of the magnetic transducer;
   c) adjusting the output signal of the magnetic transducer according to the bias angle to determine the roll orientation of the projectile with respect to the local vector.
2. The method of claim 1, wherein the step of determining a bias angle comprises calculating the bias angle based from known models of the external magnetic field.
3. The method of claim 1, wherein the bias angle is transmitted to the projectile before launching the projectile.
4. The method of claim 1, wherein the external magnetic field comprises the Earth's magnetic field.
5. The method of claim 1, wherein the sensitive plane of the magnetic transducer is transverse to a longitudinal axis of the projectile.
6. The method of claim 1, wherein the local vector comprises a local vertical.
7. The method of claim 1, wherein the projectile includes a directional burst zone, and the projectile may be programmed to detonate with the directional burst zone oriented at a predetermined roll angle with respect to the local vector.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A system for determining roll orientation of a projectile comprising:

a projectile having a longitudinal axis;

a magnetic transducer which generates an output signal as said projectile travels through an external magnetic field; and a roll angle determination circuit that calculates an uncompensated roll angle of the projectile based upon the output signal generated by the magnetic transducer and sums the uncompensated roll angle with a bias angle constant to determine a compensated roll angle of the projectile, the bias angle constant comprising an angle between a vector component of said external magnetic field and a local reference vector fixed with respect to said external magnetic field.

2. The system of claim 1, wherein the projectile includes a directional burst zone oriented lateral to said longitudinal axis, and the projectile is programmed to detonate with the directional burst zone oriented at a predetermined roll angle with respect to the local reference vector.

3. The system of claim 1, wherein the bias angle is measured and transmitted to the roll angle determination circuit before launching the projectile.

4. The system of claim 1, wherein the bias angle is selected from a chart.

5. The system of claim 1, wherein the uncompensated roll angle of the projectile comprises the roll angle of the projectile with respect to said external magnetic field.

6. The system of claim 5, wherein the uncompensated roll angle of the projectile comprises the roll angle of the projectile with respect to a two-dimensional vector component of the external magnetic field disposed in the sensitive plane of the magnetic transducer.

7. The system of claim 6, wherein the sensitive plane of the magnetic transducer is transverse to the longitudinal axis of the projectile.

8. The system of claim 5, wherein the external magnetic field comprises the Earth's magnetic field.

9. The system of claim 1, wherein the compensated roll angle of the projectile comprises a roll angle of the projectile with respect to the local reference vector.

10. The system of claim 1, wherein the local reference vector is oriented within a local fixed coordinate system through which the projectile travels.

11. The system of claim 1, wherein the local reference vector is a local vertical.

12. The system of claim 1, wherein the bias angle comprises an angle between the local reference vector and the two-dimensional vector component of the external magnetic field disposed in the sensitive plane of the magnetic transducer.

13. The system of claim 12, wherein the projectile includes a lateral directional burst zone, and the roll orientation of the burst zone is determined with respect to the local reference vector by adjusting the compensated roll angle according to a directional burst zone adjustment angle.

14. The system of claim 13, wherein the directional burst zone adjustment angle comprises an angle between a sensitive axis of the magnetic transducer and a burst zone vector extending in the direction of the directional burst zone.

15. The system of claim 1, wherein the projectile is unguided.

16. The system of claim 1, wherein the projectile includes a directional burst zone centered upon a sensitive axis of said magnetic transducer.

17. A fuze for use with a projectile comprising:

a magnetic transducer which generates an output signal as said projectile travels through an external magnetic field;

a roll angle determination circuit which calculates a compensated roll angle by determining an uncompensated roll angle using the output signal generated by the magnetic transducer and summing the uncompensated roll angle with a bias angle constant to determine a compensated roll angle of the projectile, the bias angle constant comprising an angle between a vector component of said external magnetic field and a local reference vector fixed with respect to said external magnetic field.

18. The fuze of claim 17, wherein the uncompensated roll angle of the projectile comprises the roll angle of the projectile with respect to the external magnetic field.

19. The fuze of claim 17, wherein the compensated roll angle of the projectile comprises a roll angle of the projectile with respect to said local reference vector.

20. The system of claim 19, wherein the projectile comprises a lateral directional burst zone, and the fuze calculates a roll orientation of the lateral directional burst zone by summing the compensated roll angle and a directional burst zone adjustment angle.

21. A method of determining the roll orientation of a projectile comprising:

a) providing a projectile having a magnetic transducer which generates an output signal corresponding to an uncompensated roll angle of the projectile according to an external magnetic field;

b) determining a bias angle between a predetermined local vector and a two-dimensional vector component of the external magnetic field disposed in a sensitive plane of the magnetic transducer; and c) determining the roll orientation of the projectile with respect to the local vector by summing the uncompensated roll angle and the bias angle.

22. The method of claim 21, wherein the step of determining a bias angle comprises calculating the bias angle based from known models of the external magnetic field.

* * * * *

UNITED STATES PATENT AND TRADEMARK OFFICE

CERTIFICATE OF CORRECTION

PATENT NO. : 7,566,027 B1
APPLICATION NO. : 11/342736
DATED : July 28, 2009
INVENTOR(S) : Johnson et al.

It is certified that error appears in the above-identified patent and that said Letters Patent is hereby corrected as shown below:

On the cover page,

[*] Notice: Subject to any disclaimer, the term of this patent is extended or adjusted under 35 USC 154(b) by 450 days Delete the phrase "by 450 days" and insert -- by 629 days --

Signed and Sealed this

Sixth Day of April, 2010

David J. Kappos

David J. Kappos
*Director of the United States Patent and Trademark Office*